US011315781B2

(12) United States Patent
Fujii et al.

(10) Patent No.: US 11,315,781 B2
(45) Date of Patent: Apr. 26, 2022

(54) MASS SPECTROMETER

(71) Applicant: JEOL Ltd., Tokyo (JP)

(72) Inventors: Masatoshi Fujii, Tokyo (JP); Junkei Kou, Tokyo (JP)

(73) Assignee: JEOL Ltd., Tokyo (JP)

( * ) Notice: Subject to any disclaimer, the term of this patent is extended or adjusted under 35 U.S.C. 154(b) by 0 days.

(21) Appl. No.: 17/110,546

(22) Filed: Dec. 3, 2020

(65) Prior Publication Data

US 2021/0175065 A1 Jun. 10, 2021

(30) Foreign Application Priority Data

Dec. 4, 2019 (JP) ..... JP2019-219298

(51) Int. Cl.
*H01J 49/00* (2006.01)
*H01J 49/42* (2006.01)
*H01J 49/02* (2006.01)

(52) U.S. Cl.
CPC ..... *H01J 49/427* (2013.01); *H01J 49/005* (2013.01); *H01J 49/0031* (2013.01); *H01J 49/0036* (2013.01); *H01J 49/025* (2013.01)

(58) Field of Classification Search
USPC ..... 250/282
See application file for complete search history.

(56) References Cited

U.S. PATENT DOCUMENTS 4,755,670 A * 7/1988 Syka ..... H01J 49/027 250/282
6,852,971 B2 * 2/2005 Baba ..... H01J 49/0045 250/282
8,198,580 B2 * 6/2012 Schwartz ..... H01J 49/0418 250/281
8,258,462 B2 * 9/2012 Remes ..... H01J 49/0009 250/252.1
8,604,420 B2 * 12/2013 Kou ..... H01J 49/422 250/282
2006/0016977 A1 1/2006 Kawato
2011/0284740 A1 11/2011 Okumura
2011/0291003 A1 12/2011 Kou
2012/0160998 A1 6/2012 Kou
2015/0179419 A1 6/2015 Silivra et al.
(Continued)

FOREIGN PATENT DOCUMENTS

EP 2390900 A2 11/2011
JP 2000340170 A 12/2000
JP 200632207 A 2/2006
(Continued)

OTHER PUBLICATIONS

Extended European Search Report issued in EP20210453.5 dated Apr. 12, 2021.
Office Action issued in JP2019219298 dated Oct. 26, 2021.

*Primary Examiner* — Phillip A Johnston
(74) *Attorney, Agent, or Firm* — The Webb Law Firm

(57) ABSTRACT

A sampling period of an A/D converter is set in accordance with an ion pulse ejection operation of a collision cell of an accumulation type. Start timing of the sampling period is changed in accordance with a selected m/z of a second mass analysis unit. In addition, end timing of the sampling period may be changed in accordance with the selected m/z of the second mass analysis unit. In place of the sampling period, a data cut-out period may be changed.

5 Claims, 12 Drawing Sheets

(56) References Cited

U.S. PATENT DOCUMENTS

| | | | | |
|---|---|---|---|---|
| 2016/0025742 | A1* | 1/2016 | Reichardt ..... | C12P 19/18<br>435/18 |
| 2017/0125233 | A1 | 5/2017 | Mizutani et al. | |

FOREIGN PATENT DOCUMENTS

| | | | |
|---|---|---|---|
| JP | 2010127714 | A | 6/2010 |
| JP | WO2010089798 | A1 | 8/2010 |
| JP | 2011249069 | A | 12/2011 |
| JP | 2012138270 | A | 7/2012 |
| JP | 2014222165 | A | 11/2014 |
| WO | 2015151160 | A1 | 8/2015 |

* cited by examiner

64A

| SELECTED MASS | START DELAY TIME |
|---|---|
| m≦m1 | $Td_{ads_m1}$ |
| m1 < m≦m2 | $Td_{ads_m2}$ |
| m2 < m≦m3 | $Td_{ads_m3}$ |
| --- | --- |
| mn-1 < m≦mn | $Td_{ads_mn}$ |

FIG. 5

64B

| SELECTED MASS | START DELAY TIME | END DELAY TIME |
|---|---|---|
| $m \leqq m1$ | $Td_{ads_m1}$ | $Td_{ade_m1}$ |
| $m1 < m \leqq m2$ | $Td_{ads_m2}$ | $Td_{ade_m2}$ |
| $m2 < m \leqq m3$ | $Td_{ads_m3}$ | $Td_{ade_m3}$ |
| ... | ... | ... |
| $mn\text{-}1 < m \leqq mn$ | $Td_{ads_mn}$ | $Td_{ade_mn}$ |

64C

| SELECTED MASS | SLOPE | INTERCEPT |
|---|---|---|
| m≦m2 | A2 | B2 |
| m2 < m≦m3 | A3 | B3 |
| --- | --- | --- |
| mn-1 < m≦mn | An | Bn |

78

98

| SELECTED MASS | OPTIMAL DELAY TIME |
|---|---|
| $m_1$ | $T_{d5}$ |
| $m_2$ | $T_{d6}$ |
| $m_3$ | $T_{d8}$ |
| $m_4$ | $T_{d10}$ |
| ..... | ..... |

MASS SPECTROMETER

CROSS REFERENCE TO RELATED APPLICATION

This application claims priority to Japanese Patent Application No. 2019-219298 filed Dec. 4, 2019, the disclosure of which is hereby incorporated by reference in its entirety.

BACKGROUND OF THE INVENTION

Field of the Invention

The disclosure relates to a mass spectrometer, and specifically relates to a mass spectrometer of an ion accumulation type.

Description of Related Art

A mass spectrometer of an ion accumulation type includes, for example, an ion source, a first mass analysis unit, a collision cell, a second mass analysis unit, and a detector (for example, see JP 2012-138270 A). In the collision cell, precursor ions are caused to collide against collision gas to generate fragmentation in all or a part of the precursor ions, thereby generating product ions that are fragment ions. In the collision cell, an inlet electrode and an outlet electrode are provided, and the potentials of those electrodes are independently controlled, so that product ions are temporarily accumulated in the collision cell, and the accumulated product ions are thereafter ejected from the collision cell. The ions to be ejected configure an ion pulse. Employing the accumulation type (which can be also referred to as an accumulation ejection type) can make the mass spectrometer highly sensitive.

The first mass analysis unit selects precursor ions that are first target ions to be introduced into the collision cell by using a difference in the mass-to-charge ratio (m/z). Similar to the first mass analysis unit, the second mass analysis unit selects, by using a difference in the m/z, product ions to be passed therethrough that are second target ions. From such a viewpoint, each of the first mass analysis unit and the second mass analysis unit can be referred to as a mass filter.

Note that, when each of the first mass analysis unit, the collision cell, and the second mass analysis unit are provided with a quadrupole, the mass spectrometer is called a triple quadrupole mass spectrometer. On the precondition of the configuration, when the collision cell performs an accumulation operation, the mass spectrometer is called an accumulation-type triple quadrupole mass spectrometer. Mass spectrometers provided with another accumulation unit such as an ion trap have also been known.

SUMMARY OF THE INVENTION

In the mass spectrometer of an accumulation type, a data capturing period is cyclically set in accordance with a cyclic ejection operation of the accumulation unit. This aims to improve the signal noise ratio (SN ratio) without capturing invalid data that is not derived from the detection of ions; in other words, by rejecting or excluding an invalid detection signal. Herein, the data capturing period is typically a period when output signals from the detector are sampled, and if it is generally expressed, a period when data to be provided to the data processing unit is delimited.

The time during when ions ejected from the accumulation unit pass through the second mass analysis unit and reach the detector changes depending on the mass (more accurately, the mass-to-charge ratio selected by the second mass analysis unit) of the ions. When the data acquisition period is fixed under such conditions, the data acquisition period does not correspond to the valid data period that changes depending on the selected m/z of the ion.

Note that, the abovementioned JP 2012-138270 A proposes that the reference potential (specifically, the axis potential) of the second mass analysis unit is changed to make the kinetic energy of ions uniform, independent of the m/z of the ions. With the proposal, it is possible to match the data capturing period with respect to valid data to be generated in the detection of ions, independent of the m/z to be selected. However, in many cases it is difficult to make the kinetic energy of ions entirely uniform.

An object of the disclosure is to optimize the data acquisition period suit to the period of valid ion signal generated by the detector, regardless of the mass-to-charge ratio selected.

A mass spectrometer according to the disclosure includes: an accumulation unit that accumulates ions, and ejects the accumulated ions; a mass analysis unit that causes, in the ions ejected from the accumulation unit, ions having a selected mass-to-charge ratio to pass therethrough; a detector that detects the ions having passed through the mass analysis unit; a sampling circuit that samples an output signal from the detector; a data processing unit that is provided in a post stage of the sampling circuit; and a control unit that controls, in accordance with the selected mass-to-charge ratio, a data capturing period when data to be processed by the data processing unit is delimited.

BRIEF DESCRIPTION OF THE DRAWINGS

An embodiment of the present disclosure will be described based on the following figures, wherein:

FIG. 5 is a diagram illustrating a time management table according to a second example;

DESCRIPTION OF THE INVENTION

Figure 1:
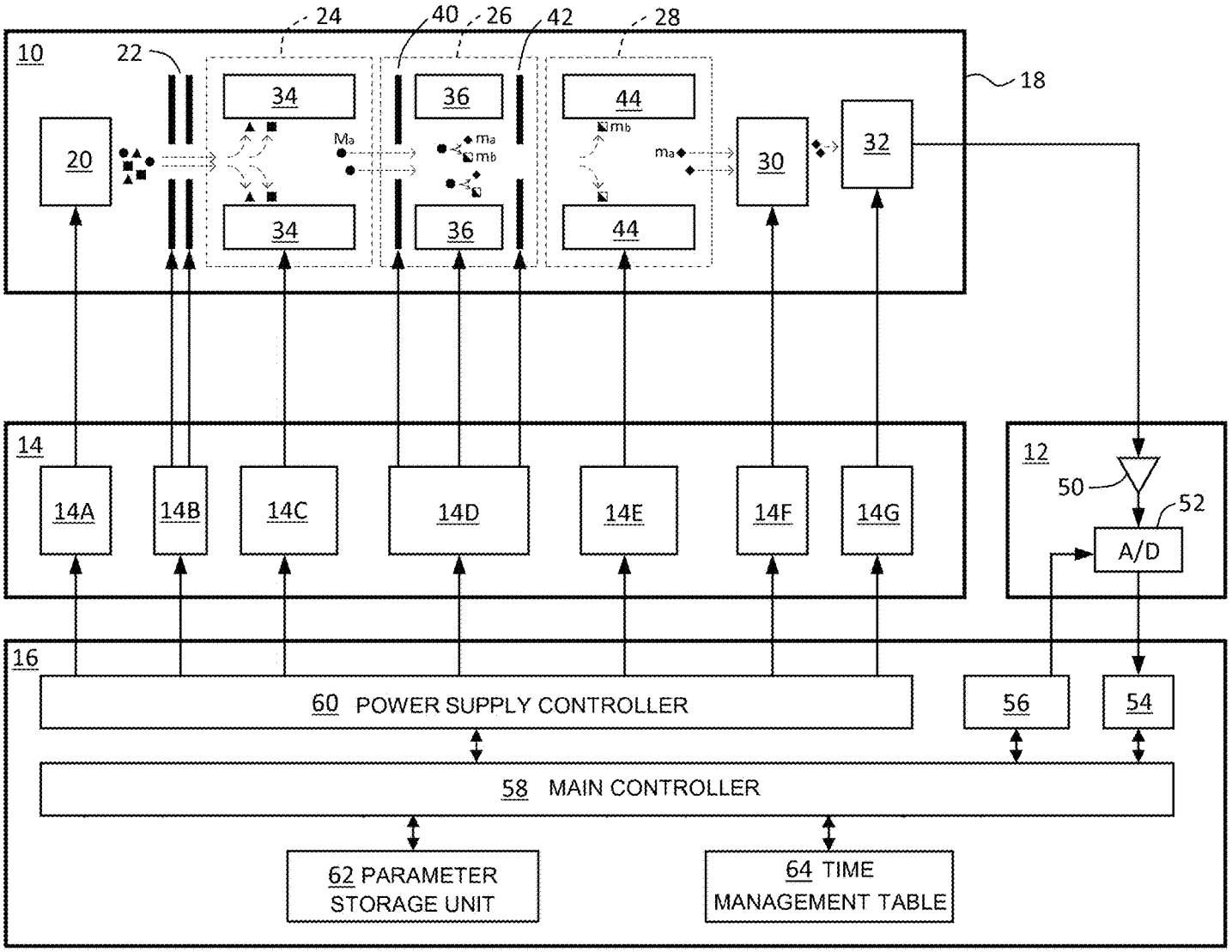
FIG. 1 is a block diagram illustrating a mass spectrometer of an accumulation type according to an embodiment.

Hereinafter, an embodiment is described based on the drawings.

(1) Overview of Embodiment

A mass spectrometer according to the embodiment includes an accumulation unit, a mass analysis unit, a detector, a sampling circuit, a data processing unit, and a control unit. The accumulation unit accumulates ions, and ejects the accumulated ions. The mass analysis unit causes, among the ions ejected from the accumulation unit, ions having a selected mass-to-charge ratio to pass therethrough. The detector detects the ions having passed through the mass analysis unit. The sampling circuit samples an output signal from the detector. The data processing unit is a processing unit provided in a post stage of the sampling circuit. The control unit controls, in accordance with the selected mass-to-charge ratio, a data capturing period when data to be processed by the data processing unit is delimited.

In accordance with the mass-to-charge ratio (hereinafter, may also referred be to as "selected mass") selected by the mass analysis unit, the time from when the ions are ejected from the accumulation unit to when the ejected ion reach the detector changes. In other words, on a time axis, a period when valid data to be generated by the detection of ions is present changes in accordance with the selected mass. With the abovementioned configuration, the data capturing period can be adjusted with respect to the period when the valid data is present, so that it is possible to set more valid data as a data processing target; in other words, to suppress noise data from becoming a processing target. Accordingly, it is possible to attain an improvement in the sensitivity and an improvement in the SN ratio.

The control of the data capturing period can be performed by various methods. The first method can include a method of adjusting a detection operation period of a detector with respect to an ion detection period (ion arrival period). The second method can include a method of, on the precondition that the detector is caused to continuously operate, adjusting a sampling operation period of the sampling circuit with respect to a period of valid signal that is derived from the detection of ions. The third method can include a method of, on the precondition that the detector and the sampling circuit are caused to continuously operate, extracting valid data that is derived from the detection of ions due to the control of a cut-out period of the data output from the sampling circuit, and providing the valid data to the data processing unit. The data capturing period is a broad concept, and as a result, is a section or a range on the time axis that delimits information to be processed by the data processing unit.

In the embodiment, the accumulation unit is a collision cell. In particular, the accumulation unit is a collision cell that is provided with an entrance electrode and an exit electrode. The abovementioned mass analysis unit is a second mass analysis unit provided in a post stage of the accumulation unit, and a first mass analysis unit is provided in a front stage of the accumulation unit.

In the embodiment, the control unit adjusts the data capturing period with respect to the valid data, by increasing a delay time at start timing in the data capturing period with an increase in the selected mass-to-charge ratio. With the increase in the selected mass-to-charge ratio, the timing when the ions reach the detector is delayed. The abovementioned configuration delays, by considering such delay of the timing, the start timing of the data capturing period in accordance with the increase in the selected mass-to-charge ratio.

In the embodiment, the control unit adjusts the data capturing period with respect to the valid data, by increasing a delay time at end timing in the data capturing period with an increase in the selected mass-to-charge ratio. This configuration causes the end timing of the data capturing period to change, different from the start timing of the data capturing period or with the start timing of the data capturing period, thereby adjusting the data capturing period with respect to valid data.

The mass spectrometer according to the embodiment includes a table which stores a plurality of pieces of time information corresponding to a plurality of mass-to-charge ratios or a plurality of mass-to-charge ratio ranges that are selectable by the mass analysis unit. The control unit specifies time information corresponding to the selected mass-to-charge ratio by referring to the table. In addition, the control unit controls the data capturing period in accordance with the specified time information. The table scheme allows easy control of the data capturing period.

The mass spectrometer according to the embodiment includes a table which stores a plurality of pieces of coefficient information corresponding to a plurality of mass-to-charge ratios or a plurality of mass-to-charge ratio ranges that are selectable by the mass analysis unit. The control unit specifies coefficient information corresponding to the selected mass-to-charge ratio by referring to the table. Subsequently, the control unit specifies time information corresponding to the selected mass-to-charge ratio by substituting the selected mass-to-charge ratio and the specified coefficient information into a prescribed function. In addition, the control unit controls the data capturing period in accordance with the specified time information. The function scheme makes it easy to adjust the data capturing period more precisely.

(2) Details of Embodiment

FIG. 1 discloses a mass spectrometer according to the embodiment. The mass spectrometer is a device that executes a mass analysis with respect to the sample. A gas chromatography device may be provided in the front stage of the mass spectrometer.

In FIG. 1, the mass spectrometer includes a measurement unit 10, an electronic circuit 12, a power source unit 14, and a computing control unit 16. The measurement unit 10 includes a vacuum chamber 18. The measurement unit 10 also includes an ion source 20, a first mass analysis unit 24, a collision cell 26, a second mass analysis unit 28, a deflector 30, and a detector 32. Note that, the configuration illustrated in FIG. 1 serves as a precondition for any of first to fourth examples, which will be described below.

The ion source 20 ionizes the introduced sample, thereby generating ions. As an ionization method, various kinds of methods can be selected. A lens 22 is provided between the ion source 20 and the first mass analysis unit 24.

The first mass analysis unit 24 includes a quadrupole (specifically, four pole electrodes) 34 in the embodiment. The first mass analysis unit 24 extracts precursor ions serving as first target ions and having a specified m/z. In other words, the first mass analysis unit 24 causes only precursor ions having a specified m/z to pass therethrough.

The m/z to be set with respect to the first mass analysis unit 24 corresponds to a first selected mass.

The collision cell 26 functions as an accumulation unit, and includes a quadrupole 36, an entrance electrode 40, and an exit electrode 42 in the embodiment. Collision gas is present in the collision cell 26, and all or a part of precursor ions having entered the collision cell 26 is fragmented by colliding against molecules configuring the collision gas. Accordingly, product ions serving as fragment ions are generated.

The collision cell 26 intermittently performs an ejection operation, and more specifically, cyclically performs an accumulation ejection operation. The potential of the entrance electrode 40 is controlled to select an open (the potential that causes ions from the first mass analysis unit 24 to enter the collision cell 26) or an ejection (the potential that causes ions in the collision cell 26 to be pushed out to a side of the exit electrode 42). The potential of the exit electrode 42 is controlled to select an accumulation (the potential that causes ions to remain in the collision cell 26) or an ejection (the potential that causes ions in the collision cell 26 to be drawn out to the second mass analysis unit 28). When positive ions are measured, the potential of the exit electrode 42 is lowered to eject the ions accumulated in the collision cell 26 as an ion pulse to the second mass analysis unit 28, and when negative ions are measured, the potential of the exit electrode 42 is raised to eject the ions accumulated in the collision cell 26 as an ion pulse to the second mass analysis unit 28.

The second mass analysis unit 28 includes a quadrupole 44 in the embodiment. The second mass analysis unit 28 extracts precursor ions serving as second target ions and having a specified m/z. In other words, the second mass analysis unit 28 causes the precursor ions having a specified m/z to pass therethrough. The m/z selected in the second mass analysis unit 28 corresponds to a second selected mass.

The deflector 30 has a function of bending an orbit of the ions having passed through the second mass analysis unit 28. The detector 32 that detects ions is provided in a post stage of the deflector 30. Particles such as neutral particles that cause noise cannot pass through the deflector 30, and do not reach the detector 32. The detector 32 outputs a detection signal serving as an analog signal.

In FIG. 1, precursor ions Ma having a first selected mass in the precursor ions generated in the ion source 20 pass through the first mass analysis unit 24, and enter the collision cell 26. The precursor ions Ma are fragmented in the collision cell 26 to generate fragment ions ma and mb. The fragment ions ma having a second selected mass in the ion pulse including those fragment ions ma and mb pass through the second mass analysis unit 28. The detector 32 detects the fragment ions ma.

The electronic circuit 12 includes, in the illustrated configuration example, an amplifier 50 that amplifies a detection signal, and an A/D converter 52 that samples the amplified detection signal. The A/D converter 52 is a sampling circuit, and a sampling clock is supplied thereto. The A/D converter 52 generates, from a detection signal serving as an analog signal, detection data serving as a digital signal. As is described later, in the first to third examples, the A/D converter 52 performs a cyclic sampling operation in accordance with the cyclic ejection operation of the collision cell 26. As is described later, in the fourth example, the A/D converter 52 performs a continuous sampling operation.

The computing control unit 16 includes, for example, an information processing device including a processor, and functions as a computing unit and a control unit. The computing control unit 16 includes a data collecting unit 54, a sampling controller 56, a main controller 58, a power supply controller 60, a parameter storage unit 62, and a time management table 64.

The data collecting unit 54 includes a memory, and detection data from the A/D converter 52 is stored in the memory. As is described later, in the first to third examples, the data collecting unit 54 intermittently performs data capturing in synchronization with a sampling operation period of the A/D converter 52. In other words, the data collecting unit 54 collects only a plurality of pieces of valid data derived from a plurality of ion pulses. In the first to third examples, each of an individual sampling period and an individual data collecting period corresponds to a data capturing period. The setting of the sampling operation period corresponds to the delimitation of the data capturing period.

As is described later, in the fourth example, the data collecting unit 54 exhibits a function of cutting out a plurality of pieces of valid data derived from a plurality of ion pulses, from data to be output from the A/D converter 52 that continuously operates. The individual cut-out periods are respectively data capturing periods. Cutting-out of a plurality of pieces of valid data corresponds to the delimitation of the plurality of data capturing periods. In any of the examples, valid data that is generated due to the ion pulse detection serves as a data processing target, and invalid data that is not derived from the ion pulse is excluded or rejected.

The sampling controller 56 controls an operation of the A/D converter 52. In the first to third examples, which will be described later, under the control by the main controller 58, the sampling controller 56 sets a sampling operation period of the A/D converter 52.

The main controller 58 includes a function of controlling operations of the respective configurations illustrated in FIG. 1, and a function of processing information acquired in the detection of ions. The control by the main controller 58, in particular, control of a data collecting period, will be described later in detail.

The power source unit 14 includes a plurality of power supply circuits 14A to 14G. The individual power supply circuits 14A to 14G include a function of supplying electric power and/or a function of controlling the potential. The first selected mass is selected by the control of the prescribed potential in the first mass analysis unit 24. Similarly, the second selected mass is selected by the control of the prescribed potential in the second mass analysis unit 28.

The parameter storage unit 62 connected to the main controller 58 stores various kinds of parameters necessary for the control of an operation of the measurement unit 10. The time management table 64 connected to the main controller 58 stores time information or coefficient information necessary for the control of adjusting the data capturing period with respect to valid data generated due to the detection of ion pulses.

The main controller 58 includes, for example, a CPU that executes a program. The main controller 58 may include another device, such as a GPU, an ASIC, or an FPGA. The main controller 58 may function as the data collecting unit 54.

By using FIGS. 2 to 4, the first example will be described. In the first example, in accordance with the second selected mass, start timing in each sampling operation period of the A/D converter is variably controlled. Specifically, the start delay time that defines the start timing in each sampling operation period is variably controlled such that each data capturing period is adjusted with respect to valid data (specifically, valid detection signal) that is derived from each ion pulse.

Figures 2, 3:
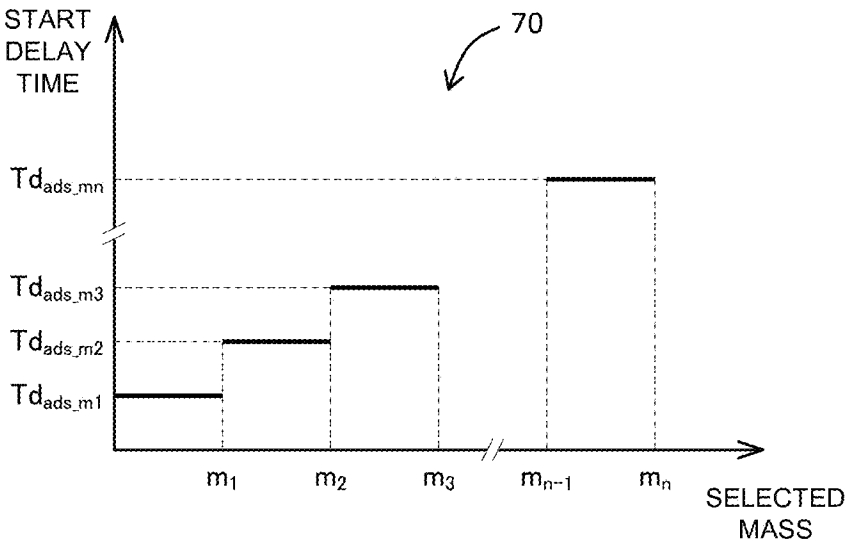
FIG. 2 is a diagram illustrating a time management table according to a first example.
FIG. 3 is a diagram illustrating a relation between a selected mass and a start delay time in the first example.

FIG. 2 illustrates a configuration example of a time management table according to the first example. A time management table 64A includes a plurality of records, and in each record, a start delay time corresponding to the selected mass (the second selected mass, accurately, the second selected mass range) is managed. For example, when the selected mass m is equal to or less than m1, $Td_{ads_m1}$ is determined as a start delay time $Td_{ads}$. When the selected mass m is more than m1 and equal to or less than m2, $Td_{ads_m2}$ is determined as the start delay time $Td_{ads}$. The start delay time is a time (delay time), using the ejection operation start timing of the collision cell as a reference time, from the reference time to the sampling operation start timing.

In accordance with the mass (in other words, the selected mass) of individual ions that pass through the second mass analysis unit and configure the ion pulse, a period (ion arrival period) when the ions reach the detector changes. The selected mass increases to delay the start timing of the ion arrival period. Therefore, the start delay time is determined for every selected mass range. Note that, in the first example, the sampling operation period itself is fixed.

In FIG. 3, the content of the abovementioned time management table is illustrated as a content graph 70. The horizontal axis represents the selected mass, and the longitudinal axis represents the start delay time. With the increase in the selected mass, the start delay time increases stepwise.

Figure 4:
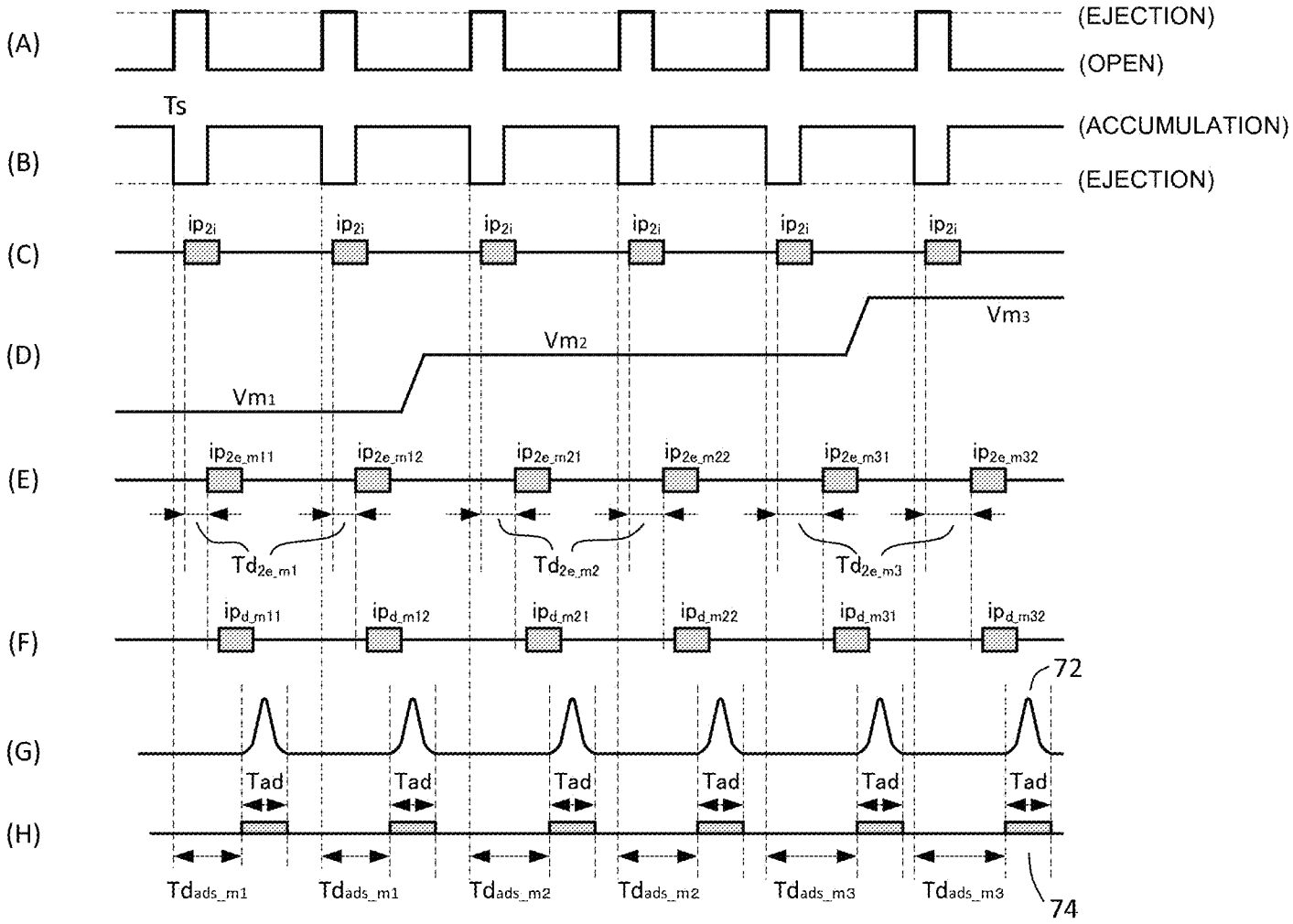
FIG. 4 is a timing chart illustrating operations according to the first example.

FIG. 4 illustrates an operation in the first example as a timing chart. In FIG. 4, (A) indicates the potential of the inlet electrode in the collision cell. The inlet electrode repeats the open operation and the ejection operation.

(B) indicates the potential of the outlet electrode in the collision cell. The outlet electrode repeats the accumulation operation and the ejection operation. In other words, the collision cell intermittently ejects an ion pulse. The start timing of each ejection period is a reference time, which is indicated as Ts. (C) indicates the ion pulse that enters the second mass analysis unit.

(D) indicates a plurality of selected masses that are successively set in the second mass analysis unit; specifically, a plurality of selection potentials that define a plurality of selected masses or the change in the selection potentials. Note that, in FIG. 4, three selection potentials $Vm_1$, $Vm_2$, and $Vm_3$ are illustrated. (E) indicates ion pulses that pass through an outlet of the second mass analysis unit. A delay time $Td_{2e}$ at a head timing of an individual ion pulse depends on the mass of individual ions configuring the ion pulse; in other words, the selected mass. For example, when the selected mass is $Vm_1$, the delay time $Td_{2e}$ becomes $Td_{2e_m1}$. When the selected mass is $Vm_2$, the delay time $Td_{2e}$ becomes $Td_{2e_m2}$.

(F) indicates ion pulses that reach the detector. In the first example, the detector continuously performs a detection operation. A signal acquired within the ion pulse arrival period is a valid signal, and signals acquired in the other periods are noise. (G) indicates detection signals that are continuously input to the A/D converter. The detection signal includes a plurality of peaks (a plurality of valid signals) that are derived from a plurality of ion pulses (see reference numeral 72).

(H) indicates an operation of the A/D converter. Each sampling operation period Tad is expressed by a gray band (see reference numeral 74), and in the first example the time length thereof is a fixed value. The start delay time (the delay time from the reference time Ts) $Td_{ads}$ in each sampling operation period is controlled based on the time management table illustrated in FIG. 2. When the selected mass m is $m_1$, the start delay time $Td_{ads}$ is $Td_{ads_m1}$, and when the selected mass m is $m_2$, the start delay time $Td_{ads}$ is $Td_{ads_m2}$. With the increase in the selected mass, the start delay time is increased.

Accordingly, a plurality of sampling operation periods are adjusted with respect to a plurality of peaks generated by the detection of a plurality of ion pulses. In other words, individual data capturing periods are adjusted with respect to individual valid data that changes in accordance with the selected mass. Note that, in a period when a plurality of peaks are not present, the sampling is not executed. The period can be referred to as an invalid period.

The abovementioned main controller functions as a data processing unit or functions as a part of the data processing unit. By the main controller, for every sampling operation period, data sequences obtained within the period are integrated. A plurality of integrated values are acquired for every selected mass, and are further integrated to obtain a total integrated value. The change in the total integrated value in the change in the selected mass is plotted to generate a mass spectrum.

The start timing of the ion arrival period may be adjusted by changing the reference potential (axis potential) in the second mass analysis unit, and changing the kinetic energy of ions that pass therethrough. When the delay time of the start timing in the ion arrival period cannot be made entirely uniform even with such adjustment, applying the configuration according to the present embodiment allows the data capturing period to correctly match the valid data that is derived from the ion pulse.

Next, the second example will be described using FIGS. 5 to 7. In the second example, in accordance with the selected mass, both of the start timing and the end timing of the data capturing period are controlled.

FIG. 5 illustrates a configuration example of a time management table according to the second example. A time management table 64B includes a plurality of records. Each record includes a start delay time and an end delay time associated with the selected mass (selected mass range). For example, when the selected mass m is equal to or less than $m_1$, $Td_{ads_m1}$ is determined as the start delay time $Td_{ads}$, and $Td_{ade_m1}$ is determined as the end delay time $Td_{ade}$. When the selected mass m is more than $m_1$ and equal to or less than $m_2$, $Td_{ads_m2}$ is determined as the start delay time $Td_{ads}$, and $Td_{ade_m2}$ is determined as the end delay time $Td_{ade}$. Similar to the start delay time, the end delay time uses the ejection operation start timing of the collision cell as the reference time.

In the second example, with the increase in the selected mass, the control of increasing the start delay time is executed. The change in the start delay time is similar to the graph illustrated in FIG. 3. In the second example, the control of increasing the end delay time with the increase in the selected mass is further executed.

Figure 6:
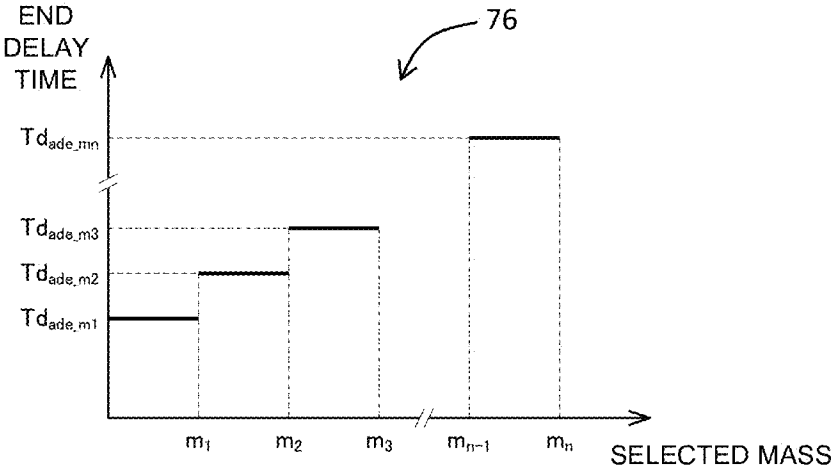
FIG. 6 is a diagram illustrating a relation between a selected mass and an end delay time in the second example.

FIG. 6 illustrates a change in the end delay time with the increase in the selected mass as a graph 76. The horizontal axis represents the selected mass, and the longitudinal axis represents the end delay time. With the increase in the selected mass, the end delay time increases stepwise.

Figure 7:
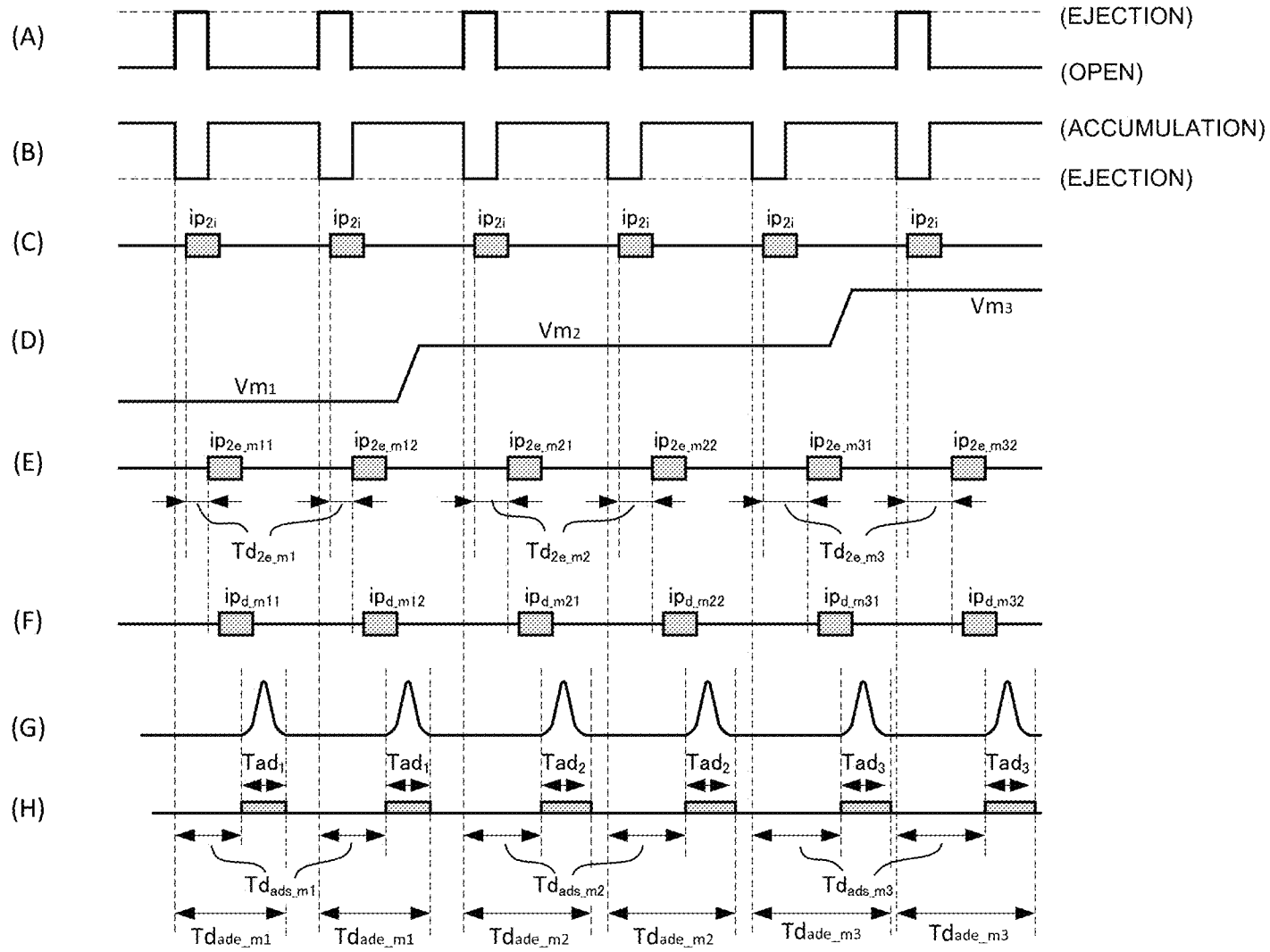
FIG. 7 is a timing chart illustrating operations according to the second example.

FIG. 7 illustrates a timing chart according to the second example. In FIG. 7, the same reference numerals are assigned to similar elements illustrated in FIG. 4, and repeated explanations thereof are omitted.

In the second example, as indicated in (H), both of the start delay time $Td_{ads}$ and the end delay time $Td_{ade}$ are adaptively controlled for every sampling operation period, in accordance with the selected mass. The sampling operation period Tad that is defined by the start delay time $Td_{ads}$ and the end delay time $Td_{ade}$ increases with an increase in the selected mass. Specifically, in the course of the change in the selected mass m from $m_1$, $m_2$, to $m_3$, the sampling period Tad gradually increases from $Tad_1$, $Tad_2$, to $Tad_3$.

With the second example, it is possible to adjust a plurality of data acquiring periods with respect to a plurality of pieces of valid data that are derived from a plurality of ion pulses, and implement a more excellent SN ratio. Specifically, it is possible to entirely adjust the operation period of the A/D converter with respect to a period when valid signals are input to the A/D converter.

Note that, also in the second example, the technique of changing the kinetic energy of ions by changing the reference potential of the second mass analysis unit may be employed in combination. This also applies to the third example and the fourth example, which will be described below.

Next, the third example will be described using FIGS. 8 and 9. In the third example, the start delay time is changed continuously with respect to a change in the selected mass.

Figures 8, 9:
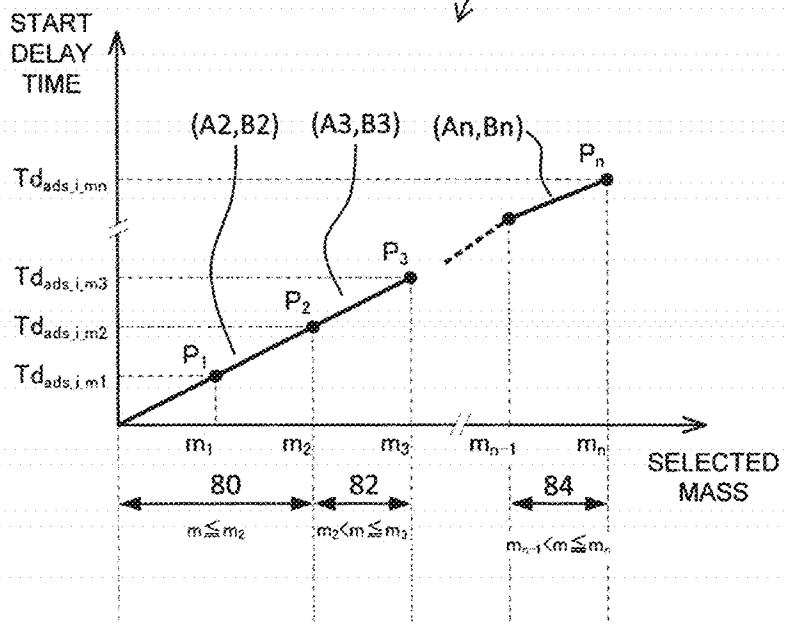
FIG. 8 is a diagram illustrating a relation between a selected mass and a start delay time in a third example.
FIG. 9 is a diagram illustrating a delay time management table according to the third example.

As is specifically described, in FIG. 8, the horizontal axis represents the selected mass, and the longitudinal axis represents the start delay time. An individual optimal start delay time corresponding to an individual selected mass is determined by an experiment and the like, and is plotted (see $P_1$ to $P_n$) to generate a line graph 78 illustrated in FIG. 8. In the line graph 78, for every section, as two coefficients that define a primary expression, a slope and an intercept, are specified. For example, a slope A2 and an intercept B2 are specified for a section 80, a slope A3 and an intercept B3 are specified for a section 82, and a slope An and an intercept Bn are specified for a section 84.

The coefficient group specified in the foregoing configures a time management table 64C illustrated in FIG. 9. The time management table 64C includes a plurality of records corresponding to a plurality of sections, and in an individual record, two coefficients, a slope and an intercept, are managed. In the time management table 64C, coefficient information is managed.

The main controller calculates the start delay time $Td_{ads}$ by substituting a slope A and an intercept B corresponding to the selected mass m into the following expression (1).

$$Td_{ads}=A\cdot m+B \tag{1}$$

With the third example, it is possible to smoothly change the start delay time with respect to the change in the selected mass.

Figure 10:
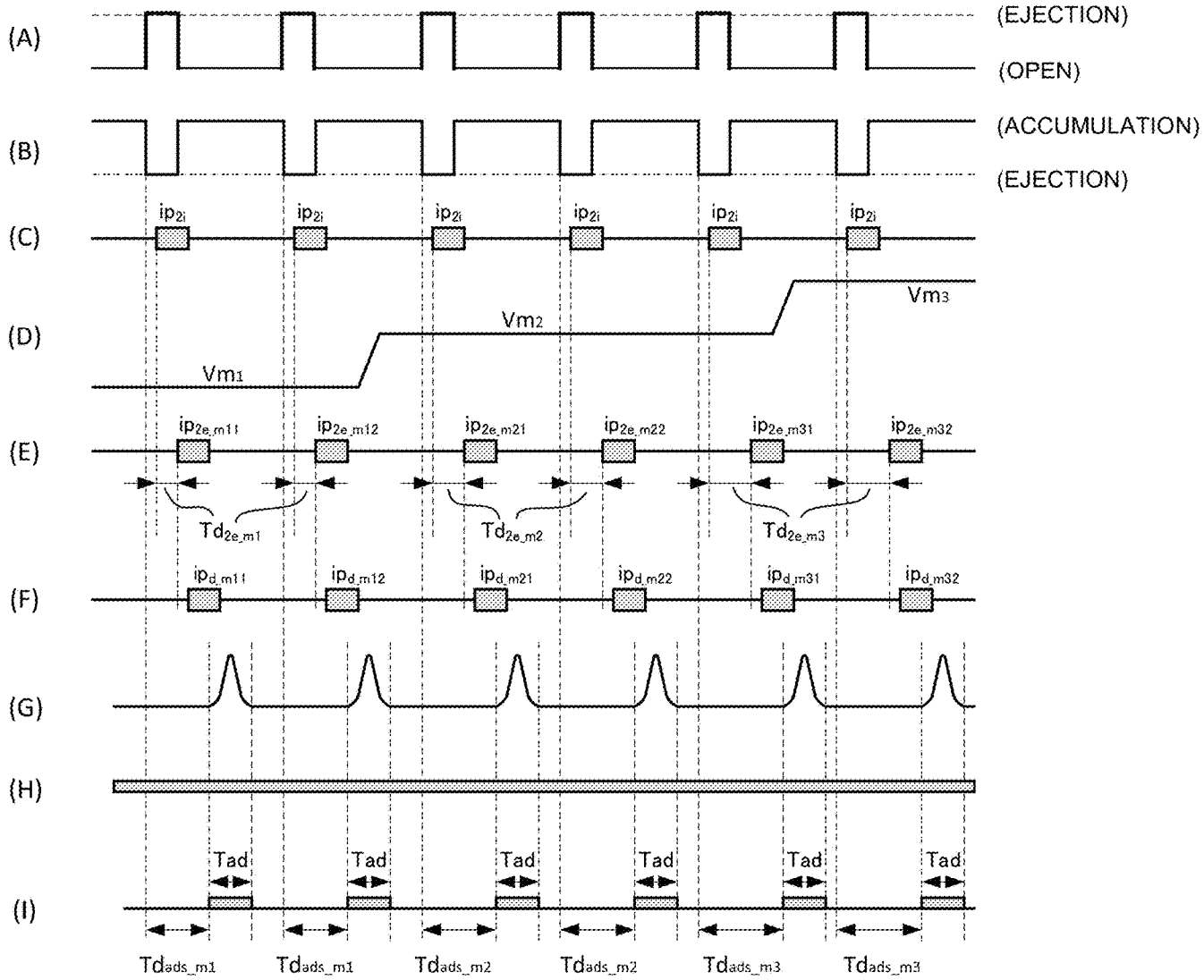
FIG. 10 is a timing chart illustrating operations according to a fourth example.

Next, the fourth example will be described using FIG. 10. In FIG. 10, the same reference numerals are assigned to similar elements illustrated in FIG. 4, and repeated explanations thereof are omitted.

In the fourth example, as indicated in (H), the A/D converter continuously performs a sampling operation. In (I), a plurality of data cut-out periods on the time axis are indicated, and those are expressed by a plurality of gray bands. The time length of each data cut-out period is Tad, and is a fixed value. The start delay time $Td_{ads}$ that defines the start timing of the data cut-out period is adaptively controlled in accordance with the selected mass. In other words, a period when valid data that is derived from the ion pulse is present is set as a data cut-out period. As a result, it is possible to adjust an individual data capturing period with respect to individual valid data.

Figure 11:
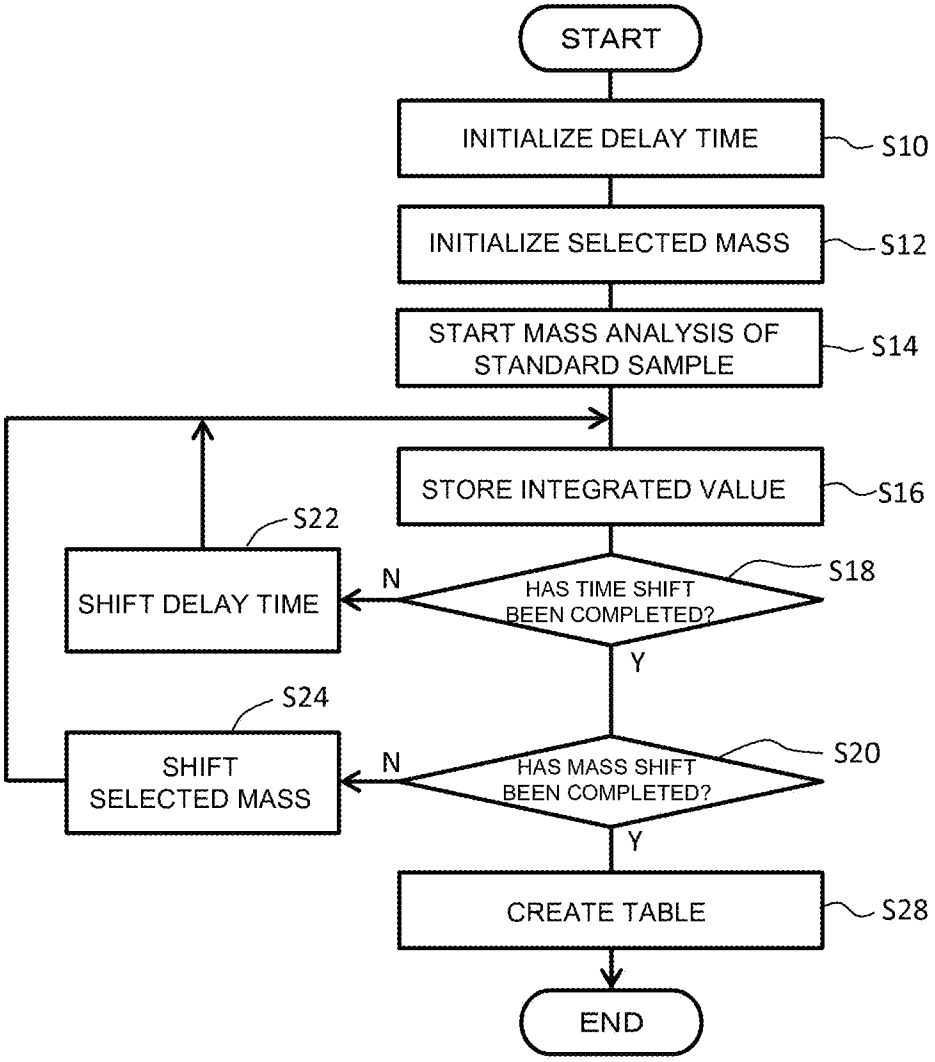
FIG. 11 is a flowchart illustrating a table creation method.

Next, using FIGS. 11 to 14, a creation example of the time management table illustrated in FIG. 2 will be described. FIG. 11 illustrates a creation method of the time management table as a flowchart. When the time management table is created, a standard specimen containing a plurality of known compounds is used.

In S10, an initial value is set as a delay time. In S12, an initial value is set as a selected mass. In S14, a mass analysis of a standard specimen is started. In S16, among detection signals acquired under the set selected mass, a signal portion in an observation window 92 is cut out, and is integrated. Accordingly, an integrated value is stored in a memory. The position of the observation window on the time axis is defined by the delay time. For example, a head position of the observation window is defined by the delay time. The observation window has a prescribed time width.

In S18, a determination is made as to whether the delay time has reached an end value, and if the delay time has not reached the end value, in S22, the delay time is increased by one step, and the process in S16 and the subsequent processes are again executed. While shifting the observation window on the time axis, an integrated value is computed on each shift position, and is stored.

In S20, a determination is made as to whether the selected mass has reached a final value. If the selected mass has not reached the final value, the selected mass is increased by one step in S24, the process in S16 and the subsequent processes are again executed. The processes at S16 to S24 are repeatedly executed, thereby obtaining a plurality of integrated value sequences corresponding to a plurality of selected masses. In S28, the plurality of integrated value sequences are analyzed, thereby creating a time management table.

Figure 12:
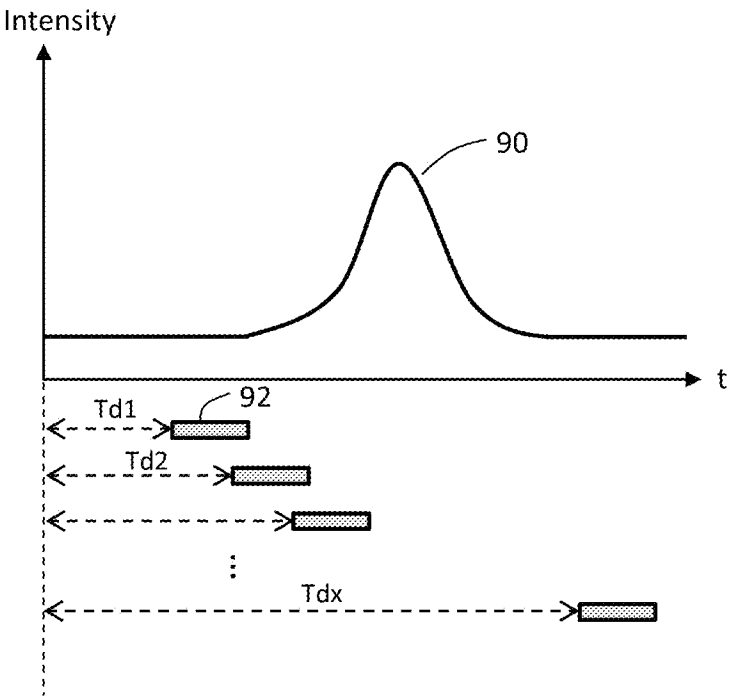
FIG. 12 is a diagram for explaining scanning in an observation window.

FIG. 12 illustrates a detection signal 90 acquired under a given selected mass. The horizontal axis represents the time axis, and the longitudinal axis represents intensity. While shifting the observation window 92 that is defined by the delay, signal components in the observation window 92 are integrated on each shift position, thereby obtaining an integrated value. A plurality of integrated values corresponding to a plurality of shift positions configure an integrated value sequence.

Figures 13, 14:
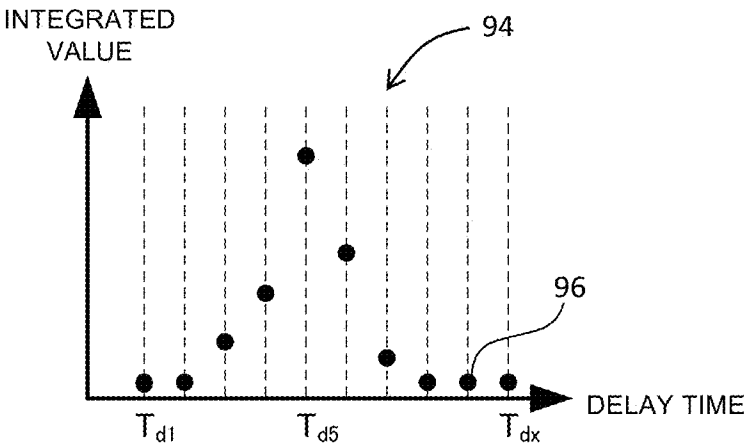
FIG. 13 is a diagram illustrating an integrated value sequence that is formed by scanning of the observation window.
FIG. 14 is a diagram illustrating the start delay time specified for every selected mass.

FIG. 13 illustrates an integrated value sequence 94 corresponding to a given selected mass. The integrated value sequence 94 includes a plurality of integrated values 96. An observation window including a rising point in the integrated value sequence 94 is specified, and a delay time corresponding to the observation window is set as an optimal delay time. The optimal delay time is determined as a start delay time.

Note that, timing when the integrated value becomes the maximum is specified, and a start delay time may be determined using the timing as a reference. Moreover, an end delay time may be specified using the method similar to the above. Note that, so long as the entire peaks included in the detection signal can be captured, the start delay time and the like may be computed by a method other than the abovementioned method.

FIG. 14 illustrates, as indicated by reference numeral 98, a plurality of pieces of optimal delay time that are specified relative to a plurality of selected masses. A plurality of pieces of optimal delay time are registered in a time management table as a plurality of pieces of start delay time.

Figure 15:
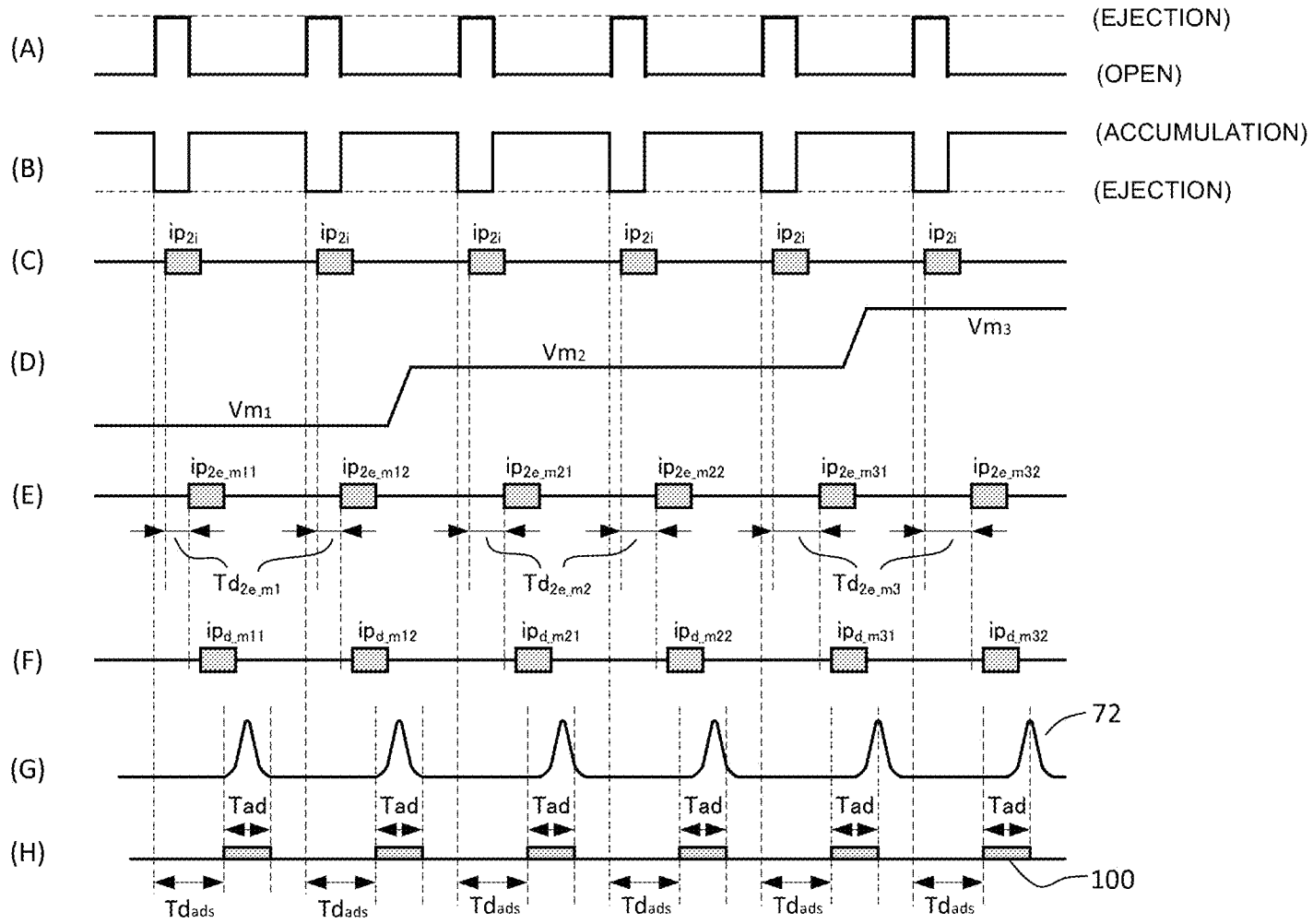
FIG. 15 is a timing chart illustrating operations according to a comparative example.

FIG. 15 illustrates a comparative example. The comparative example premises the configuration excluding the time management table 64 in FIG. 1. Note that, in FIG. 15, the same reference numerals are assigned to similar elements illustrated in FIG. 4, and repeated explanations thereof are omitted.

(G) indicates a detection signal. The detection signal includes a plurality of peaks 72 generated by the ejection operation at a plurality of times in the collision cell. With the increase in the selected mass, positions at which the plurality of peaks 72 are generated are delayed in terms of time. As indicated in (H), in the comparative example, the start delay time $Td_{ads}$ is fixed. Therefore, a plurality of sampling periods 100 (in other words, a plurality of data capturing periods) do not adjust with respect to the plurality of peaks 72.

In contrast, with the embodiment, it is possible to adjust a plurality of data capturing periods with respect to the plurality of peaks 72. With the embodiment, as compared with the comparative example, it is possible to increase the sensitivity or improve the S/N ratio.

In the abovementioned embodiment, an analysis may be performed with respect to a detection signal or detection data acquired for every selected mass to automatically compute the beginning and the end in an optimal data capturing period, and integration processing may then be performed within the data capturing period.

The invention claimed is:

1. A mass spectrometer comprising:

a first mass analysis unit;

an accumulation unit that accumulates ions ejected from the first mass analysis unit, and ejects the accumulated ions, the accumulation unit being a collision cell;

a second mass analysis unit that causes, among the ions ejected from the accumulation unit, ions having a selected mass-to-charge ratio to pass therethrough;

a detector that detects the ions having passed through the second mass analysis unit;

a sampling circuit that samples an output signal from the detector;

a data processing unit that is provided in a post stage of the sampling circuit;

a table that stores a plurality of pieces of coefficient information corresponding to a plurality of mass-to-charge ratio ranges; and a control unit that specifies coefficient information, from among the plurality of pieces of coefficient information, corresponding to the selected mass-to-charge ratio, specifies time information corresponding to the selected mass-to-charge ratio by substituting the selected mass-to-charge ratio and the specified coefficient information into a prescribed function, and controls a sampling operation period of the sampling circuit based on the specified time information to thereby control a data capturing period when data to be processed by the data processing unit is delimited, wherein each of the pieces of coefficient information comprises a slope and an intercept.

2. The mass spectrometer according to claim 1, wherein the control unit adjusts the data capturing period to the period of valid data that is derived from the ions having the selected mass-to-charge ratio.

3. The mass spectrometer according to claim 2, wherein the control unit adjusts the data capturing period to the period of valid data, by increasing a delay time at start timing in the data capturing period with an increase in the selected mass-to-charge ratio.

4. The mass spectrometer according to claim 2, wherein the control unit adjusts the data capturing period to the period of valid data, by increasing a delay time at end timing in the data capturing period with an increase in the selected mass-to-charge ratio.

5. The mass spectrometer according to claim 1, further comprising a deflector that is provided between the second mass analysis unit and the detector, and configured to bend an orbit of the ions having passed through the second mass analysis unit.

* * * * *